United States Patent [19]

Kettle et al.

[11] Patent Number: 5,032,188

[45] Date of Patent: Jul. 16, 1991

[54] METHOD FOR PAINT BRUSH PRESERVATION AND STORAGE

[75] Inventors: Morris E. G. Kettle, Aylesbury; David W. Allen, Bourne End, both of Great Britain

[73] Assignee: Lynted Corporation, Montgomery, Ala.

[21] Appl. No.: 520,830

[22] Filed: May 8, 1990

Related U.S. Application Data

[63] Continuation of Ser. No. 222,918, Jul. 18, 1988, Pat. No. 4,967,903.

[30] Foreign Application Priority Data

Dec. 9, 1986 [GB] United Kingdom ..... 8629435

[51] Int. Cl.[5] ..... B08B 3/08; B65D 81/22

[52] U.S. Cl. ..... 134/38; 206/209; 206/361

[58] Field of Search ..... 206/205, 207, 209, 209.1, 206/210, 219, 222, 216, 223, 229, 361, 362, 362.1-362.4, 15.2, 15.3, 484, 484.2, 610, 620, 621, 627, 631.1, 632, 524.1, 524.2, 524.5, 812, 828; 383/70, 89, 108; 229/3.5 M F; 106/1.18, 35; 134/6, 38; 15/257 R, 105

[56] References Cited

U.S. PATENT DOCUMENTS

| | | | |
|---|---|---|---|
| 1,934,316 | 11/1933 | Loomis | 206/15.1 |
| 2,485,068 | 10/1949 | Santana | 206/15.1 |
| 2,533,829 | 12/1950 | Merryweather | 206/15.1 |
| 2,549,039 | 4/1951 | Adams | 206/216 X |
| 2,668,129 | 2/1954 | Battle | 134/6 |
| 2,776,050 | 1/1957 | Switzer | 206/15.1 |
| 2,902,396 | 9/1959 | Reynolds | 229/3.5 MF X |
| 3,027,999 | 4/1962 | Heroy, Jr. | 206/223 |
| 3,140,196 | 7/1964 | Lacy et al. | 229/3.5 MF X |
| 3,164,695 | 1/1965 | Sanni | 206/484 |
| 3,167,178 | 1/1965 | Saunders | 206/15.1 |
| 3,179,609 | 4/1965 | Morison | 134/38 X |
| 3,188,779 | 6/1965 | Elden | 206/484 X |
| 3,398,825 | 8/1968 | Flook, Jr. et al. | 206/209 |
| 3,690,448 | 9/1972 | Switzer | 206/15.1 |
| 3,955,670 | 5/1976 | Buslik | 206/15.3 |
| 4,007,838 | 2/1977 | Awad | 206/484 |
| 4,162,163 | 7/1979 | Subelka | 106/1.18 X |
| 4,181,222 | 1/1980 | Kepets | 206/223 |
| 4,469,223 | 9/1984 | Smith | 206/209 |
| 4,606,456 | 8/1986 | Kaminski | 206/362.4 |
| 4,967,903 | 11/1990 | Kettle et al. | 206/209 |

FOREIGN PATENT DOCUMENTS

| | | | |
|---|---|---|---|
| 120928 | 2/1946 | Australia . | |
| 149160 | 5/1951 | Australia . | |
| 68251 | 7/1968 | Australia . | |
| 80612 | 2/1982 | Australia . | |
| 90751 | 11/1982 | Australia . | |
| 3306181 | 11/1984 | Fed. Rep. of Germany . | |
| 3520378 | 1/1987 | Fed. Rep. of Germany . | |
| 318667 | 2/1957 | Switzerland | 206/205 |

*Primary Examiner*—Bryon P. Gehman

*Attorney, Agent, or Firm*—Fisher, Christen & Sabol

[57] ABSTRACT

A paint brush cleaning or storage device is provided in the form of a sealed sachet (1) containing a predetermined quantity of a brush preserving cleaning liquid (3), which sachet can be opened, for example by cutting along one edge to permit the brush head (5,6) to be inserted therein immediately after use either to prevent the brush drying out and keeping it ready for reuse. Preferably the sachet is of deformable foil which can be wrapped around the brush handle (4) to reseal the sachet.

6 Claims, 2 Drawing Sheets

METHOD FOR PAINT BRUSH PRESERVATION AND STORAGE

This application is a continuation of U.S. Ser. No. 222,918 filed July 18, 1988, now U.S. Pat. No. 4,967,903, issued Nov. 6, 1990.

FIELD OF INVENTION

This invention relates to a device for the long or short term preservation and storage of used paint brushes. More particularly the invention relates to a device for the long or short term preservation and storage of used, uncleaned paint brushes under conditions such that any residual paint remaining thereon does not dry or harden, and the bristles of the brush retain their shape and flexibility for a long period of time, so that the brush can be re-used straight away without cleaning or further treatment of any sort, and substantially without regard to the length of storage, whether for a few minutes, a few hours, days or even months.

BACKGROUND

As is well known, many decorators, especially amateur or nonprofessional decorators, tend not pay sufficient attention to the care and preservation of their paint brushes following completion of a painting job and/or during intervals ranging perhaps from a few hours to one or more weeks between decorating sessions. Typically, amateur decorators tend, during such intervals, to leave their brushes soaking in white spirit with the result that the brushes dip into a slurry consisting of paint and white spirit and are in an unsatisfactory condition when painting is resumed. The bristles of such brushes then tend irreversibly to loose their pliability and/or their shape and hence have to be discarded and replaced long before such replacement should be necessary owing to fair wear and tear. Even professional decorators frequently merely leave their brushes soaking in a bucket of water over-night and such treatment tends to damage the brushes if not through hardening than at least through deformation.

PRIOR ART

In the past various proposals have been made for paint brush storage devices, either as a means to protect and store new brushes, or to protect and store paint brushes after use, and including in some cases a liquid brush cleaning or preserving component. Amongst such prior art devices there may be mentioned:

U.S. Pat. No. 1,934,316 which discloses a brush protecting device consisting of a wedge shaped sleeve designed to fit over the bristles of the brush to preserve the wedge shaped configuration and prevent paint thereon from drying out. No mention is made of any brush cleaning or preserving liquid.

U.S. Pat. No. 2,485,068 which discloses an open ended elastic sleeve into which the brush can be inserted and the end of the sleeve turned up to seal the bristles in an air-tight environment. The sleeve is open at both ends and cannot contain any brush preserving or cleaning liquid.

U.S. Pat. No. 2,533,829 which discloses a storage bag for paint brushes in the form of an envelope or bag open at one end and into which the head of the paint brush can be inserted after use. Means are provided for tying the open end of the bag tightly around the brush handle to prevent ingress of air and thereby to provide a substantially air-tight environment for the brush head which prevents drying out and hardening of any residual paint thereon. Alternatively it is suggested that the user may place some linseed oil or thinner into the bag prior to insertion of the brush into the bag.

U.S. Pat. No. 2,776,050 which discloses a water-tight bag and a wire stand therefor, and which can be used to suspend a paint brush after use with its head immersed in a brush cleaning liquid, the nature of which is not specified.

U.S. Pat. No. 3,167,178 which discloses an envelope into which the head of a paint brush can be inserted, and then used to suspend the brush from a suitable hook or nail. No liquid is used.

U.S. Pat. No. 3,690,448 which discloses a sealable plastics bag into which the whole paint brush can be placed and sealed, optionally after wrapping the bristles in a plastics wrapper and sealed with a rubber band.

U.S. Pat. No. 4,606,456 which discloses a prescored foldable cardboard or plastics wrapper which can be used to package paint brushes of different sizes.

German Patent 33 06 181 and German Published Patent Application No. 35 20 378 which disclose a sealable transparent carrier or storage bag for paint brushes into which the whole paint brush is inserted and sealed.

SUMMARY OF THE INVENTION

In contrast to the foregoing, the present invention provides a simple device which may be used by the amateur or professional to avoid such neglect and which may be used to clean or preserve their brushes, with the minimum of effort on their part, i.e. without involving the user in any cleaning of the brush, or the use of extraneous solvents or cleaning liquids. All the user has to do is open a sealed sachet containing a predetermined amount of brush cleaning or preservative liquid, and insert the brush head therein.

DETAILED DESCRIPTION

Figure 1:
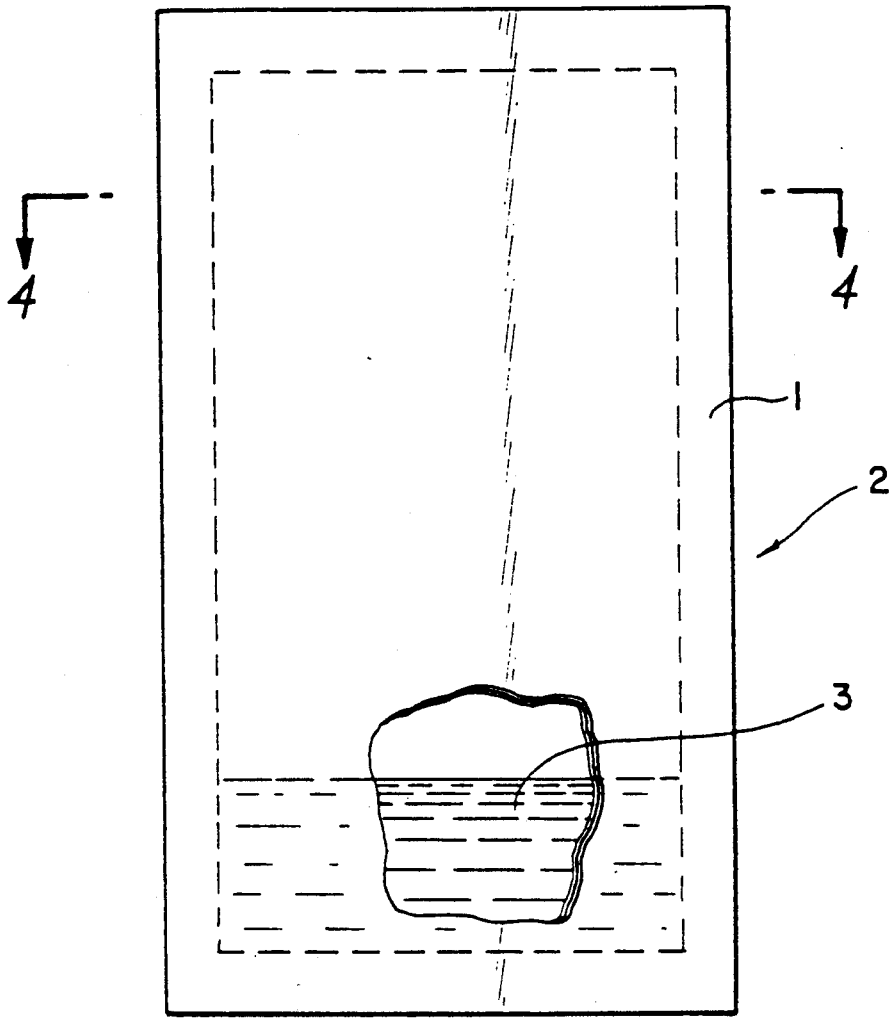

According to this invention, there is provided a sealed sachet constructed of a material substantially impermeable to air and water, e.g. a metal or plastics foil, or water-proofed paper, or, more preferably, a multiply foil comprising superimposed laminae of metal or plastics foil or paper, and into which the brush head can be inserted, immediately after use and without any prior cleaning, except perhaps for allowing undue excess of paint to run or drip off, or be scraped back into the paint container, the sachet containing a small quantity, e.g. 10–20 ml, depending on the size of the brush, of a brush preservative or cleaning liquid, preferably an aqueous liquid, which serves to prevent any paint remaining on the bristles from drying or hardening thereon, and which keeps the bristles in a soft, flexible condition. Preferably the sachet is sealable around the brush handle, or is provided with means for sealing the open mouth of the sachet around the brush handle, when the brush head is inserted therein, in order to restrict access of air into the sachet.

When it is desired to recommence painting, it is a simple matter to withdraw the brush head from the sachet, preferably at the same time squeezing the sachet gently as the bristles are withdrawn, so that excess preservative liquid is squeezed out of the bristles and drains back into the sachet, either for disposal or perhaps re-use. The brush is then immediately ready for re-use.

Using this technique, it has been found that paint brushes can be preserved uncleaned, but immediately re-usable, for periods ranging from a few minutes upto several months.

Besides preventing the drying and hardening of the paint on the bristles of the brush, and preserving the softness and flexibility of the bristles, the fact that the brush head is closely engaged by the walls of the sachet, ensures that the brush head is kept in optimum shape, i.e. with the bristles in a general wedge-shaped configuration.

Surprisingly, it has also been found that paint brushes which have been temporarily stored in this way are substantially easier to clean using conventional brush cleaner when painting has finally finished. The reason for this is not entirely clear, but is presumably due to the fact that the residual paint on the bristles is kept in a substantially undried condition, and at no time has had an opportunity to harden.

Whilst the present invention has so far been described with reference to a brush preservative liquid, preferably an aqueous brush preservative liquid, the object of the liquid primarily being to prevent residual paint remaining on the brush from drying out and thereby to preserve the bristles of the brush in an immediately reusable condition, but not specifically to clean the brush, it is also envisaged that, in accordance with a further aspect of the present invention, there is used a brush cleaning liquid, whereby the brush may not only be preserved, but actually cleaned from residual paint whilst inserted in the sachet. For this purpose a brush cleaning liquid is used which serves either to emulsify or dissolve residual paint on the bristles, as opposed to merely preventing such residual paint from drying out and hardening on the bristles. Depending on the nature of the paint, the brush cleaning liquid may be aqueous or organic, or a mixture of the two, i.e. an aqueous organic solvent mixture which dissolves or emulsifies the residual paint. Preferably there is used an aqueous or at least water miscible brush cleaning liquid, e.g. an aqueous surfactant solution, which serves to dissolve or emulsify the residual paint, so that on removal from the sachet the brush can simply by rinsed in water to complete the cleaning process, either prior to long term storage of the brush or, for example, prior to reusing the brush, but with a different colour paint.

The sachets according to this invention will usually be of a size to accommodate just a single brush head, and a variety of different sized sachets will be available for different size brushes. Preferably the dimensions of the sachet are such that the individual brush lead (including the bristles and the ferrule) is a close fit therein, in order to minimise air space within the sachet. The amount of preservative liquid sealed within each sachet will be just enough a impregnate the bristles and keep them in a softened condition. Obviously this amount will depend upon the size of the brush, and the corresponding size of the sachet, but for brushes in the size range 1 to 10 cms amounts in the range of 10 to 20 ml are found to be quite adequate.

Usually the sachets will be rectangular, but other shapes can be envisaged. Preferred materials for the sachet are plastics and metal foil laminates, particularly laminates which can be heat sealed or welded around the periphery of the sachet. Especially preferred are paper, plastics and metal foil laminates, whether single or multiply, which are deformable and which can be twisted around the projecting handle of the paint brush to seal the open end of the sachet around the brush handle to prevent ingress of air, dirt and moisture. Alternatively, other means may be provided for sealing the mouth of the sachet around the brush handle, e.g. a wire tie, tape or string, which can be tied around the brush handle or an adhesive tape or strip. In either case such a tie, tape or string can be integral with the sachet, or supplied separately.

As indicated, the sachet is initially sealed around its periphery, and contains a predetermined quantity of preservative liquid sealed therein. To insert the brush head the sachet has to be opened along one edge. This can be done quite simply by the user cutting open the sachet along one edge with a pair of scissors or a knife. Alternatively, the sachet can be provided with an inbuilt line of weakness along which the sachet can be torn open by the user, or provided with a tear-off sealing strip.

For the temporary or long term storage of the paint brushes, the individual sachets may be provided with means for suspending the sachet from a suitable hook, or perhaps from the rungs of a ladder, during short term breaks in the decorating process.

According to a preferred aspect of the present invention a brush preserving liquid which is innocuous to the bristles of the brush, maintains the bristles in a soft flexible condition, and which prevents any residual paint remaining on the bristles from drying or hardening thereon. A wide variety of different liquids may be used, both organic and inorganic, but most conveniently and preferably the preservative liquid is aqueous. Water along can be used, e.g. ordinary tap water, but preferably the aqueous preservative liquid will contain at least one additive to fulfill one or more of the following functions, viz.: (1) increase the viscosity to the preserving liquid so as to reduce, the extent of dripping of said liquid frc m a brush as it is withdrawn from the sachet; (2) lubricate the internal walls of the sachet to facilitate the brush's removal from the sachet; (3) exhibit hygroscopic action so as to tend to prevent the latter from drying out; (4) depress the freezing point of the liquid (for use in temperatures below 0° C.); (5) exhibit an antimicrobial or fungicidal action to prevent or at least inhibit the growth of bacteria or fungi in the preserving liquid; and (6) have corrosion-inhibiting properties to prevent or retard corrosion of the sheet-metal ferrule in which the bristles of a paint brush are generally set.

Particularly preferred are aqueous glycerin solutions, although aqueous solutions of other hydroscopic compounds such as propylene glycol, dipropyl glycol and higher propylene glycols, ethylene glycol, diethylene glycol, triethylene glycol and higher polymeric ethylene glycols, hexylene glycol, polyhydric alcohols and sugars can be used. Inorganic hygroscopic salts can also be used provided they do not adversely affect the paint, or the bristles or ferrule of the brush. The organic hygroscopic agents are however, preferred. Glycerin is particularly preferred as it fulfills all the functions outlined in (1) to (5) above, especially aqueous glycerin solutions containing an antioxidant, for example, sodium nitrite, and possibly a bactericide or fungicide.

Aqueous solutions containing upto 50% w/v of hygroscopic agent, e.g. glycerin may be used without detriment to the paint or the brush, but more usually upto 25% w/v. A particularly preferred aqueous preservative composition, by way of example is:

Water, plus
Glycerin 25% w/v,
Sodium nitrite 1% w/v,

Fungicide 0.34% w/v.

Almost any commercially available fungicide or bactericide may be used, a preferred example being the proprietary fungicide sold under the designation "AF-10" by Fernox Limited, of Clavering, Essex.

Figure 2A:
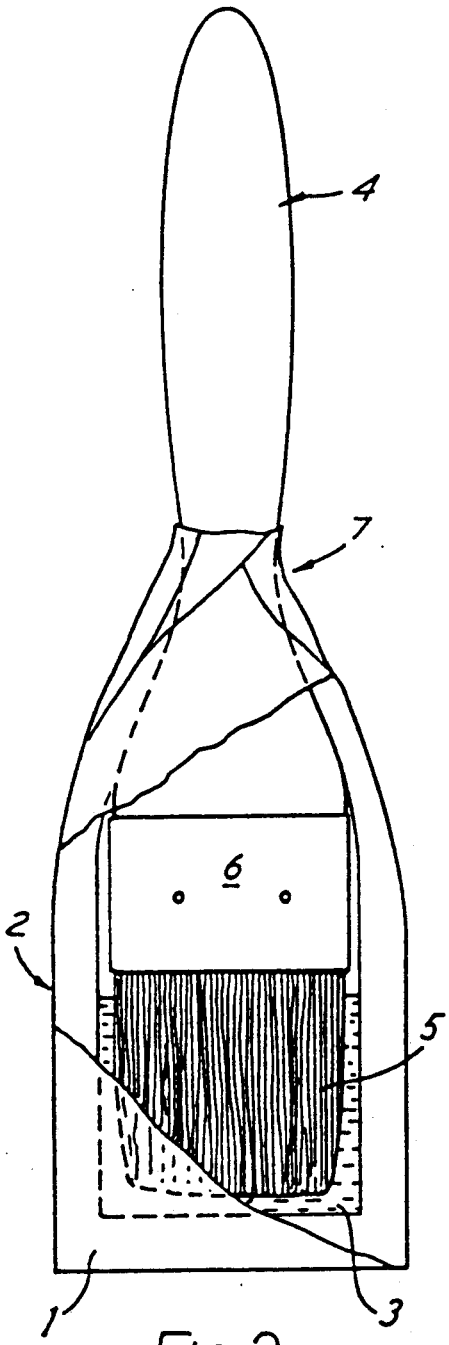
Figure 2B:
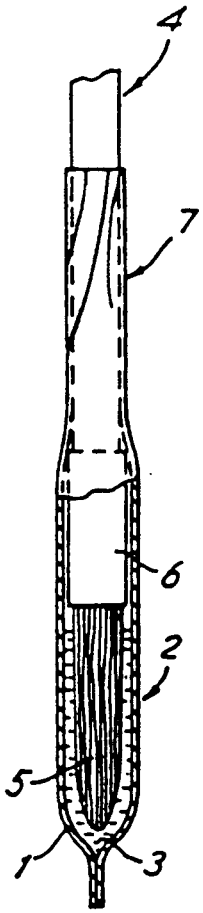
Figure 3:
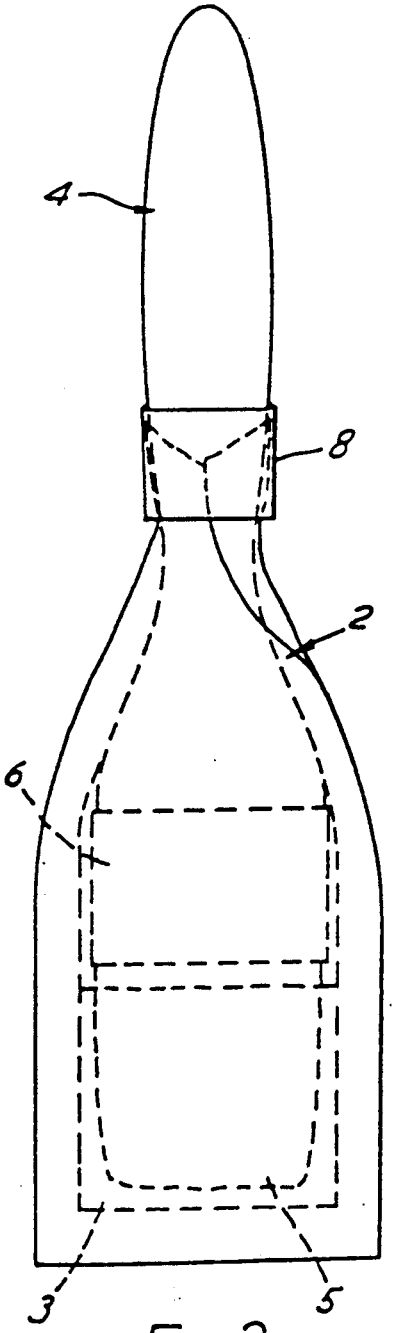

The invention is further described with reference to the accompanying drawings, in which:

FIG. 1 is a general view of the sealed sachet according to the invention;

FIG. 2*a* is a general view, part broken away, and showing a paint brush inserted into the sachet;

FIG. 2*b* is a side view of FIG. 2*a*, again with the sachet part broken away; and FIG. 3 shows an alternative method of sealing the sachet around the brush handle.

Figure 4:
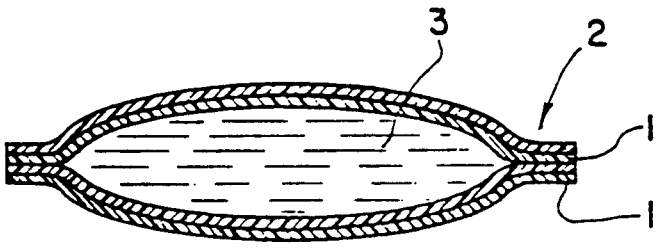

FIG. 4 is a view in cross-section of FIG. 1 along line 4—4.

Referring to FIG. 1, the sealed sachet comprises two multiply lamina (1) of metal, paper and plastics foil, such as is commercially available for a variety of different purposes in the packaging art, heat sealed one to the other around the periphery to form a sealed sachet (2) containing a small quantity, e.g. 10–15 ml, of a preservative liquid (3), preferably an aqueous glycerin solution as previously described, sealed therein. Preferably the inner surfaces of the sachet are of metal foil, the outer layer or layers being of paper or plastics, and suitably printed with advertising matter or instructions or both.

To use the sachet, for example, during a break in the decorating process, the painter or decorator opens the sachet, for example by cutting along the top edge with a pair of scissors, and inserts the paint brush (4) into the open sachet so that the bristles (5) are immersed in and soak up the preservative liquid (3), i.e. the aqueous glycerin solution. Preferably the amount of liquid is such that the liquid (3) does not actually contact the metal ferrule (6) of the brush (4). This is simply to prevent unnecessary corrosion or dirtying of the ferrule. Finally, the open mouth of the sachet is twisted around the brush handle as at (7), thereby to seal the sachet as tightly as possible around the brush handle.

In FIG. 3, the sachet is sealed around the brush handle by means of a separately applied self adhesive strip 8. Alternatively, of course, other sealing means may be used such as a wire tie, string or tape which may or may not be provided as an integral part of the sachet.

It may be emphasized here that the brush is simply inserted into the sachet immediately after use, and without any prior cleaning or treatment, except perhaps the removal of any undue excess of paint by scraping the brush against the rim of the paint container, or allowing excess paint to run or drip from the bristles. It is the function of the preservative liquid, i.e. the aqueous glycerin solution, to prevent any residual paint on the brush from drying out or hardening, and it has been found that aqueous media, particularly aqueous solutions of a hygroscopic component such as glycerin, are equally effective whether the paint is an oil-based paint, a water-based emulsion pant, a gloss paint or undercoat, or a gloss or matte or semi-matte varnish. The device of the invention is therefore useable almost irrespective of the type of paint.

Once inserted into the sachet, and the sachet preferably sealed, the brush can be stored it would seem almost indefinitely, and certainly for periods ranging from a few minutes to several hours or days or weeks. In test trials brushes have been preserved in this way for several months without deterioration, and are immediately reusable after withdrawal from the sachet.

Upon withdrawal from the sachet prior to recommencement of painting, the mouth of sachet is unsealed, and the brush withdrawn, preferably with lateral simultaneous squeezing of the walls of the sachet, so that the preservative liquid is squeezed out of the bristles and drains back into the sachet. The sachet can then be re-used, but preferably, a fresh sachet is used on each occasion. Following withdrawal, the brush can be used to recommence painting straightway, without any washing or cleaning, the old paint remaining thereon still being undried, and the bristles still soft and pliable. Moreover, as will be seen in FIG. 2*b*, the configuration of the sachet during storage helps to maintain the bristles 5 in a desired wedge-shaped configuration, rather than splayed out, which is what happens if the brush is simply stood in a container of water, or even worse, white spirit, this being the traditional method of temporary storage of used paint brushes. The desired wedge formation of the bristles is further accentuated by the action of squeezing the sachet as the brush is withdrawn and in order to squeeze the preservative liquid out of the bristles.

Although not shown, the sachet may be provided with means for suspending the sachet containing the brush from any convenient hook or even the rung of a ladder. This and numerous other modifications will be apparent to the reader and can be practiced without departing from the general scope and concept of the invention as described herein.

We claim:

1. A method of preserving a used paint brush during a temporary interruption in the use of the brush for painting, and maintaining the brush throughout the interruption in a substantially ready-to-use condition, said brush having a handle and, at the distal end of the handle, a brush head which has the bristles of the paint brush disposed thereon, whereby, at the end of the temporary interruption, painting can recommence substantially immediately without further treatment of the brush head, which method comprises:

(i) providing an unopened, presealed sachet of a size to accommodate the brush head as a close fit therein constructed of a liquid impermeable material and having a predetermined quantity of an aqueous brush preserving liquid sealed therein, said quantity being just sufficient to impregnate the bristles of the brush when the brush head is inserted into the sachet through an opening created therein and to prevent residual paint remaining on said bristles from drying out during said interruption, said aqueous brush preserving liquid comprising an aqueous solution of a water-soluble hygroscopic compound;

(ii) tearing open the sachet along an edge to create an opening therein;

(iii) inserting the brush head into the sachet through the opening created therein thereby to immerse the bristles in said predetermined quantity of aqueous brush preserving liquid; and (iv) maintaining the brush head in said sachet during said interruption with the bristles immersed in said aqueous liquid.

2. A method according to claim 1, including the step of resealing the opened edge of the sachet around the handle of the paint brush, after the tearing open of the sachet and the insertion therein of the brush head, thereby to reduce the ingress of air into the opened sachet during the said interruption.

3. A method according to claim 2, wherein the sachet is a metal foil sachet and the resealing step comprises twisting the opened edge of the sachet around the brush handle after the tearing open of the sachet and the insertion therein of the brush head.

4. A method according to claim 1, wherein the aqueous brush preserving liquid contained in the sachet is an aqueous glycerin solution.

5. A method according to claim 1, wherein the aqueous brush preserving liquid contained in the sachet is an aqueous solution of glycerin and sodium nitrite.

6. A method of preserving a used paint brush during a temporary interruption in the use of the brush for painting, and maintaining the brush throughout the interruption in a substantially ready-to-use condition, said brush having a handle and, at the distal end of the handle, a brush head which has the bristles of the paint brush disposed thereon, whereby, at the end of the temporary interruption, painting can recommence substantially immediately without further treatment of the brush head, which method comprises:

(i) providing an unopened, presealed, substantially rectangular metal foil sachet of a size to accommodate the brush head as a close fit therein and having a predetermined quantity of an aqueous brush preserving liquid sealed therein, said quantity being just sufficient to impregnate the bristles of the brush when the brush head is inserted into the sachet through an opening created therein and to prevent residual paint remaining on said bristles from drying out during said interruption, said aqueous brush preserving liquid comprising an aqueous solution of a water-soluble hygroscopic compound;

(ii) tearing open the sachet along an edge to create an opening therein;

(iii) inserting the brush head into the sachet through the opening created therein thereby to immerse the bristles in said predetermined quantity of aqueous brush preserving liquid;

(iv) twisting the opened edge of the sachet around the brush handle after insertion of the brush head into the opened sachet to reduce ingress of air into the opened sachet during the said interruption; and (v) maintaining the brush head in said sachet during said interruption with the bristles immersed in said aqueous liquid and with the opened edge of the sachet twisted around the brush handle.

* * * * *